US007786969B2

(12) United States Patent
Araki et al.

(10) Patent No.: US 7,786,969 B2
(45) Date of Patent: Aug. 31, 2010

(54) LIQUID CRYSTAL DISPLAY DEVICE AND DRIVING METHOD OF THE SAME

(75) Inventors: Shigesumi Araki, Ishikawa (JP); Kazuhiro Nishiyama, Ishikawa (JP); Mitsutaka Okita, Ishikawa (JP); Daiichi Suzuki, Miyagi (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 839 days.

(21) Appl. No.: 11/563,881

(22) Filed: Nov. 28, 2006

(65) Prior Publication Data

US 2007/0132688 A1 Jun. 14, 2007

(30) Foreign Application Priority Data

Dec. 8, 2005 (JP) ..... 2005-355104
Sep. 4, 2006 (JP) ..... 2006-239546

(51) Int. Cl.
*G09G 3/36* (2006.01)

(52) U.S. Cl. ..... 345/94; 345/87; 345/690; 349/128

(58) Field of Classification Search ..... 345/87, 345/89, 94, 690
See application file for complete search history.

(56) References Cited

U.S. PATENT DOCUMENTS 6,909,412 B2 * 6/2005 Son ..... 345/87
7,126,573 B2 * 10/2006 Park et al. ..... 345/94
7,161,574 B2 * 1/2007 Kimura et al. ..... 345/96
7,450,101 B2 * 11/2008 Arimoto et al. ..... 345/94

FOREIGN PATENT DOCUMENTS

JP 2003-279931 10/2003

* cited by examiner

*Primary Examiner*—Duc Q Dinh
(74) *Attorney, Agent, or Firm*—Oblon, Spivak, McClelland, Maier & Neustadt, L.L.P.

(57) ABSTRACT

In an OCB liquid crystal display device, a gradation voltage of a video signal is set to be lower than a black display optimum voltage, and a reverse transition prevention voltage is set to be higher than the black display optimum voltage and to be lower than a maximum applied voltage, and as the gradation voltage of the video signal becomes low, the reverse transition prevention voltage is set to be high.

29 Claims, 9 Drawing Sheets

FIG. 6

| VIDEO SIGNAL | | 0 | 1 | 2 | 3 | 4 | 5 | 6 | 7 | 8 | 9 | 10 | 11 | ··· | 245 | 246 | 247 | 248 | 249 | 250 | 251 | 252 | 253 | 254 | 255 |
|---|---|---|---|---|---|---|---|---|---|---|---|---|---|---|---|---|---|---|---|---|---|---|---|---|---|
| DRIVER GRADATION | SIGNAL | 128 | * | * | * | 129 | * | * | * | 130 | * | * | * | ··· | * | * | 253 | * | * | * | 251 | * | * | * | 255 |
| | BLACK INSERTION | 128 | * | * | * | 127 | * | * | * | 126 | * | * | * | ··· | * | * | 2 | * | * | * | 1 | * | * | * | 0 |

SIGNAL : 128 GRADATION DRV DISPLAY
→ PSEUDO-255 GRADATION DISPLAY

BLACK INSERTION : 128 GRADATION DRV DISPLAY
→ PSEUDO-255 GRADATION DISPLAY

* DENOTES THAT PSEUDO-GRADATION DISPLAY IS PERFORMED
(TIME DIVISION DISPLAY BY OUTPUT GRADATIONS AT BOTH END,ETC.)

FIG.10

| VIDEO SIGNAL | | 0 | 1 | 2 | 3 | 4 | 5 | 6 | 7 | 8 | 9 | 10 | 11 | ・・・ | 245 | 246 | 247 | 248 | 249 | 250 | 251 | 252 | 253 | 254 | 255 |
|---|---|---|---|---|---|---|---|---|---|---|---|---|---|---|---|---|---|---|---|---|---|---|---|---|---|
| DRIVER GRADATION | SIGNAL | 32 | 33 | 34 | 35 | 36 | 37 | 38 | 39 | * | 40 | 41 | 42 | ・・・ | 246 | 247 | * | 248 | 249 | 250 | 251 | 252 | 253 | 254 | 255 |
| | BLACK INSERTION | 32 | 32 | 32 | 32 | 32 | 32 | 32 | 32 | 31 | 31 | 31 | 31 | ・・・ | 1 | 1 | 1 | 0 | 0 | 0 | 0 | 0 | 0 | 0 | 0 |

SIGNAL : 224 GRADATION DRV DISPLAY
→ PSEUDO-255 GRADATION DISPLAY

BLACK INSERTION : 32 GRADATION DRV DISPLAY

* DENOTES THAT PSEUDO-GRADATION DISPLAY IS PERFORMED
(TIME DIVISION DISPLAY BY OUTPUT GRADATIONS AT BOTH END,ETC.)

LIQUID CRYSTAL DISPLAY DEVICE AND DRIVING METHOD OF THE SAME

CROSS-REFERENCE TO RELATED APPLICATIONS

This application is based upon and claims the benefit of priority from the prior Japanese Patent Application No. 2005-355104, filed on Dec. 8, 2005 and the prior Japanese Patent Application No. 2006-239546, filed on Sep. 4, 2006; the entire contents of which are incorporated herein by reference.

TECHNICAL FIELD

The present invention relates to a liquid crystal display device.

BACKGROUND OF THE INVENTION

Conventionally, a TN (Twisted Nematic) liquid crystal display device is generally used as a liquid crystal display device, however, in order to improve moving image visibility, an OCB liquid crystal display device characterized by high speed response is proposed.

As shown in FIG. 1, in the OCB (Optically Compensated Bend) liquid crystal display device 100, an OCB liquid crystal 106 is sandwiched between an array substrate 102 and a counter substrate 104. In the array substrate 102, an array electrode 110 is formed on an upper surface of an insulating glass substrate 108, and a phase difference plate 112 and a polarizing plate 114 are bonded to a lower surface of the glass substrate 108. On the other hand, in the counter substrate 104, a phase difference plate 116 and a polarizing plate 118 are bonded to an upper surface of a glass substrate 120, and a counter electrode 122 is formed on a lower surface of the glass substrate 120.

In this liquid crystal display device 100, in a state before power is turned on, as shown in FIG. 2A, the orientation state of the liquid crystal 106 is in a spray orientation state. Then, power is turned on to apply a relatively large voltage to the liquid crystal 106 in a short time by voltage application means, and as shown in FIG. 2B, the orientation of the liquid crystal 106 is caused to transition to a bend orientation state. The feature of the OCB type is that an image is displayed by using this bend orientation state.

In this OCB liquid crystal display device 100, in order to keep the bend orientation state, a reverse transition prevention voltage is applied in each frame for a period with a specific ratio or more, and the reverse transition to the spray orientation state is prevented. At this time, when the reverse transition prevention voltage is made equal to the optimum black display voltage, a high contrast is ensured, and moving image visibility can be improved.

In order to prevent the occurrence of the reverse transition from the bend orientation to the spray orientation, it is necessary to apply the reverse transition prevention voltage of a specific voltage or higher for a specific period or longer.

Accordingly, in the case where it is necessary to set the reverse transition prevention voltage to be higher than the optimum black display voltage, there is a problem that black display quality must be sacrificed.

Besides, in order to keep the black display quality, it is necessary to make the reverse transition prevention voltage substantially equal to the optimum black display voltage. However, in this case, it is necessary to prevent the reverse transition by setting an application period of the reverse transition prevention voltage to be long, that is, by setting the period (black insertion ratio) in which the reverse transition prevention voltage is applied in a frame to be long (high), or by setting a white display voltage to be high. However, in such a case, since the display time ratio (display time occupied in the frame period) is reduced, or the white brightness is reduced, there is a problem that the use efficiency of light is remarkably impaired.

In order to solve this problem, JP-A-2003-279931 proposes to change a black insertion ratio and a black insertion voltage (reverse transition prevention voltage) according to the peak brightness of a video signal.

However, in the method of JP-A-2003-279931, there remains a problem that the black display quality in a video signal in which white and black are mixed in a selected line is sacrificed.

Then, in view of the above problems, the invention provides an OCB liquid crystal display device in which the black display quality is not sacrificed even in a video signal in which black and white are mixed in a selected line, and a driving method of the same.

BRIEF SUMMARY OF THE INVENTION

According to embodiments of the present invention, in a driving method of a liquid crystal display device to perform an image display by combining a video image displayed by a gradation voltage based on a video signal and a reverse transition prevention image displayed by a reverse transition prevention voltage for keeping a bend orientation state of liquid crystal molecules, the reverse transition prevention voltage is determined based on the gradation voltage in display pixel unit, and the reverse transition prevention image is displayed based on the corresponding reverse transition prevention voltage in the display pixel unit.

According to the invention, even in the video signal in which black and white are mixed in the selected line, the black display quality is not sacrificed.

BRIEF DESCRIPTION OF THE DRAWINGS

FIG. 6 is a conceptual view of a correspondence table of the first embodiment.

FIG. 10 is a conceptual view of a correspondence table of a third embodiment.

DETAILED DESCRIPTION OF THE INVENTION

First Embodiment

Hereinafter, a liquid crystal display device 10 of a first embodiment of the invention will be described with reference to FIG. 3 to FIG. 8. The liquid crystal display device 10 of this embodiment is an OCB type normally white liquid crystal display device.

(1) Structure of the Liquid Crystal Display Device 10

Figure 1:
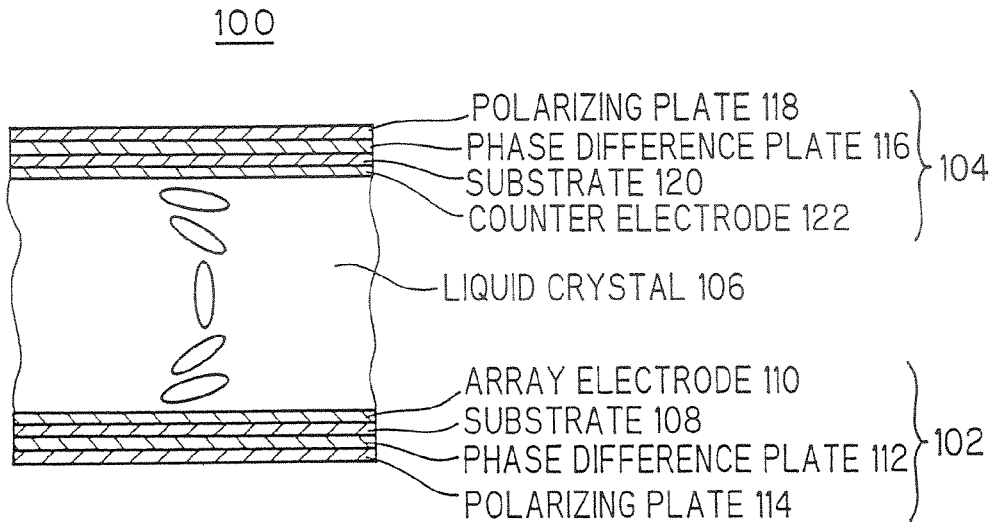
FIG. 1 is a general structural view of an OCB display mode.
Figure 2:
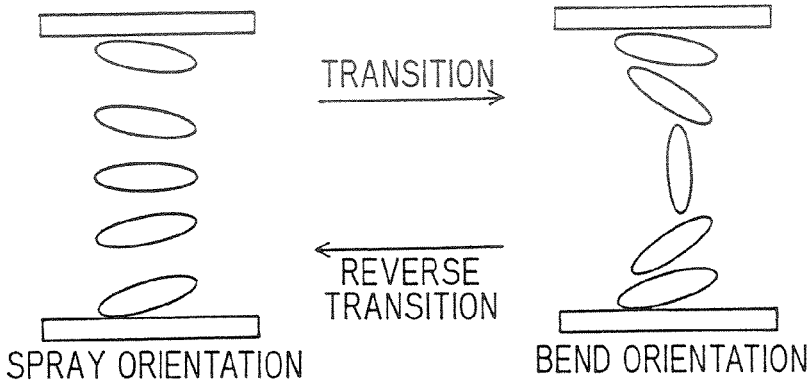
FIG. 2 is an explanatory view showing states of a spray orientation and a bend orientation of the OCB display mode.
Figure 3:
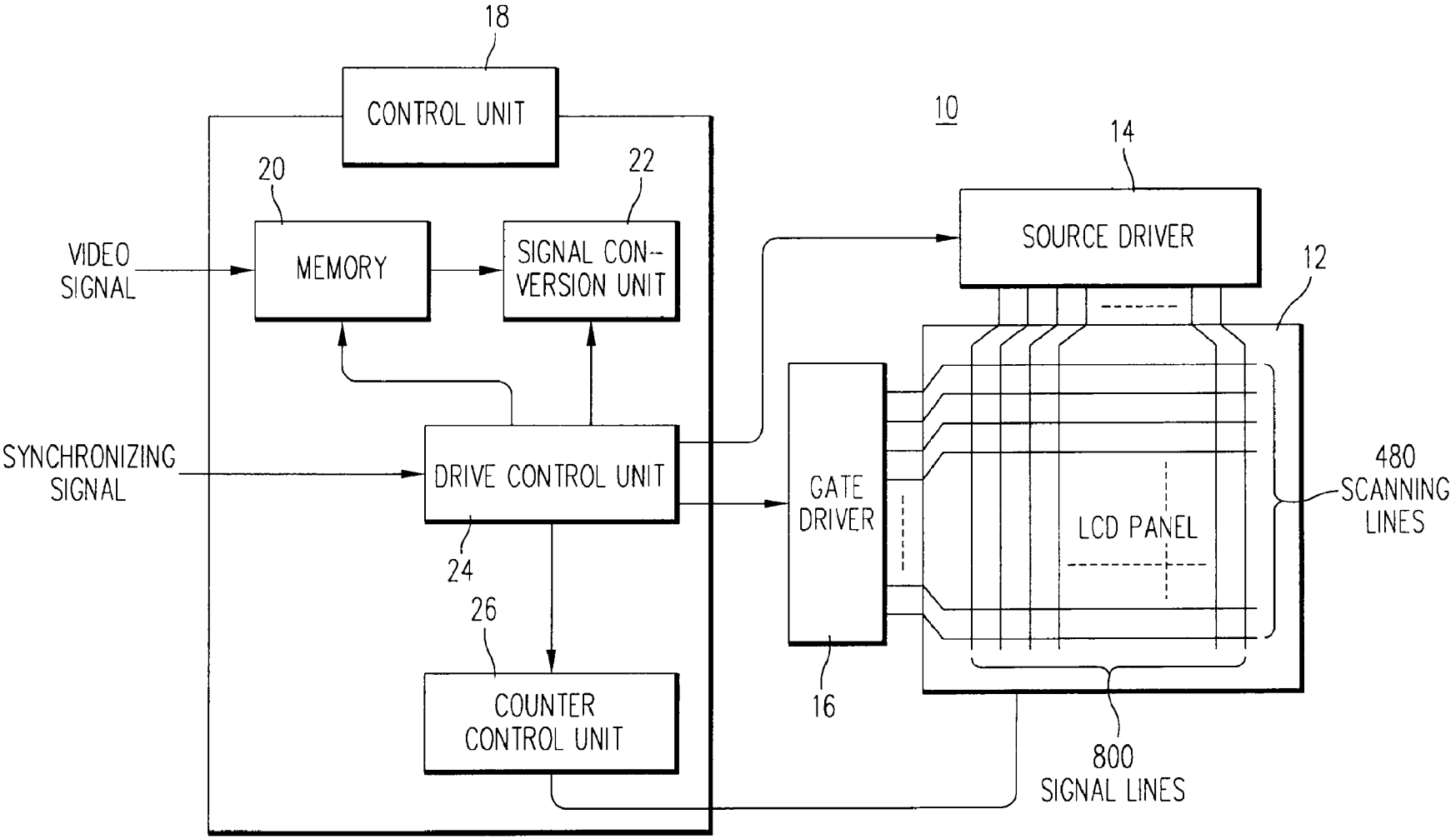
FIG. 3 is a block diagram of a liquid crystal display device of a first embodiment.

The structure of the liquid crystal display device 10 will be described based on the block diagram of FIG. 3.

A liquid crystal panel 12 of the liquid crystal display device 10 has an effective display area of 9 inches in diagonal size, and as described above, a liquid crystal is sandwiched between an array substrate and a counter substrate. On the array substrate, 800 signal lines and 480 scanning lines are disposed to be orthogonal to each other, and a polysilicon thin film transistor (TFT) is formed in the vicinity of each of intersections of the signal lines and the scanning lines. A source electrode of the TFT is connected to the signal line, a gate electrode is connected to the scanning line, and a drain electrode is connected to a pixel electrode. A source driver 14 and a gate driver 16 are connected to the liquid crystal panel 12. The plural signal lines are connected to the source driver 14, and the plural scanning lines are connected to the gate driver 16.

The liquid crystal display device 10 includes also a control unit 18. The control unit 18 includes a memory 20, a signal conversion unit 22, a drive control unit 24, and a counter control unit 26. A video signal inputted from the outside is once stored in the memory 20, and based on a synchronizing signal inputted from the outside, the drive control unit 24 outputs the analog video signal stored in the memory 20 to the signal conversion unit 22. The outputted analog video signal is AD-converted in synchronization with a horizontal synchronizing signal from the drive control unit 24 and is outputted as a digital video signal to the source driver 14. The drive control unit 24 outputs a horizontal synchronizing signal, a horizontal start signal and the like based on the synchronizing signal. Besides, the drive control unit 24 outputs a vertical synchronizing signal, a vertical start signal and the like to the gate driver 16 based on the synchronizing signal. Further, the drive control unit 24 controls a voltage to be applied to the counter substrate through the counter control unit 26.

Further, the drive control unit 24, the memory 20 and the signal conversion unit 22 perform a control to output a reverse transition prevention voltage typically applied in the OCB type.

(2) Output Method of Reverse Transition Prevention Voltage

Next, an output method of a reverse transition prevention voltage will be described with reference to FIG. 4 to FIG. 8.

As described in the Background of the Invention section, in the OCB liquid crystal display device, it is necessary that a video image based on a video signal in one frame and a reverse transition prevention voltage image displayed by a reverse transition prevention voltage for keeping a bend orientation state of liquid crystal molecules are alternately displayed in one frame.

Figure 4:
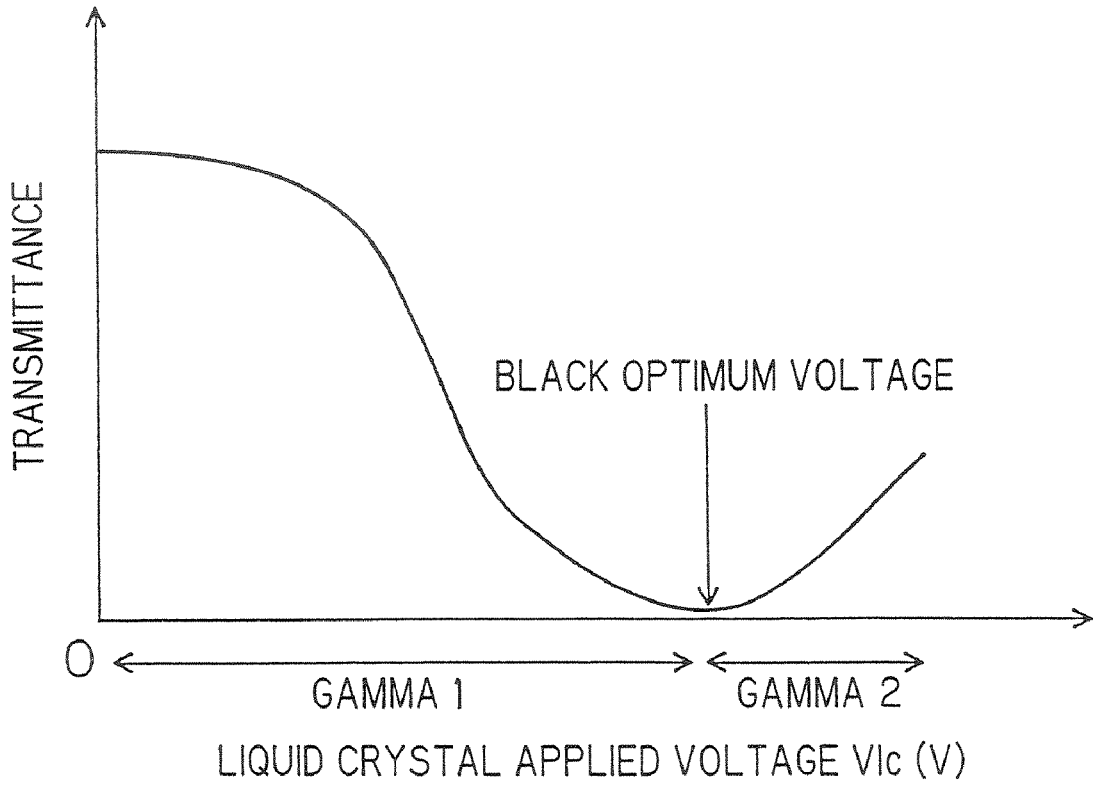
FIG. 4 is a graph showing a voltage-transmittance characteristic in the OCB display mode.

FIG. 4 shows a gradation-voltage relation in which a voltage is applied in accordance with an input signal while a optimum black display voltage of 4.5 V at which black image is displayed optimally in the liquid crystal panel 12 is made the center. The optimum black display voltage is a voltage at which the display brightness becomes a minimum value. The optimum black display voltage is used as a boundary, and an area of voltage lower than the optimum black display voltage is defined as an area of γ1, and an area of voltage higher than the optimum black display voltage is defined as γ2.

In a conventional OCB liquid crystal display device, only the area of γ1 is used, and a voltage applied in the black insertion period is made constant. That is, the gradation voltage for performing the video display is in the range of γ1, and the reverse transition prevention voltage (black insertion voltage) for keeping the bend orientation is made equal to the optimum black display voltage. In the method as stated above, excellent black display quality can be obtained, however, in the case where the optimum black display voltage is lower than the reverse transition prevention voltage, there is a fear that the reverse transition occurs according to the display image. Thus, in order to prevent the reverse transition, it becomes necessary to prolong an application period of the reverse transition prevention voltage, that is, the black insertion ratio, or to set the white display voltage to be high, and sufficient light use efficiency can not be obtained. Besides, in the method of patent document 1, although the light use efficiency can be improved without causing the reverse transition, the black display quality in, for example, a video signal in which black and white are mixed in a selected line is sacrificed.

Then, in this embodiment, in order to solve this problem, in the case where video display is performed, the gradation voltage is applied in the range of γ1, and the reverse transition prevention voltage is applied in a range including the range of γ2, more specifically, the range of γ2. Then, the relation between the gradation voltage of the digital video signal and the reverse transition prevention voltage is made such that as the gradation voltage of the digital video signal becomes low (transmittance becomes high), the reverse transition prevention voltage is made high (transmittance is high). Incidentally, a maximum value of the reverse transition prevention voltage is made a maximum applied voltage in the liquid crystal panel 12. For example, the range of γ2 in this embodiment is set to be from the optimum black voltage of 4.5 V to the maximum voltage of 6 V, and this range is used as the black insertion voltage.

Figure 5:
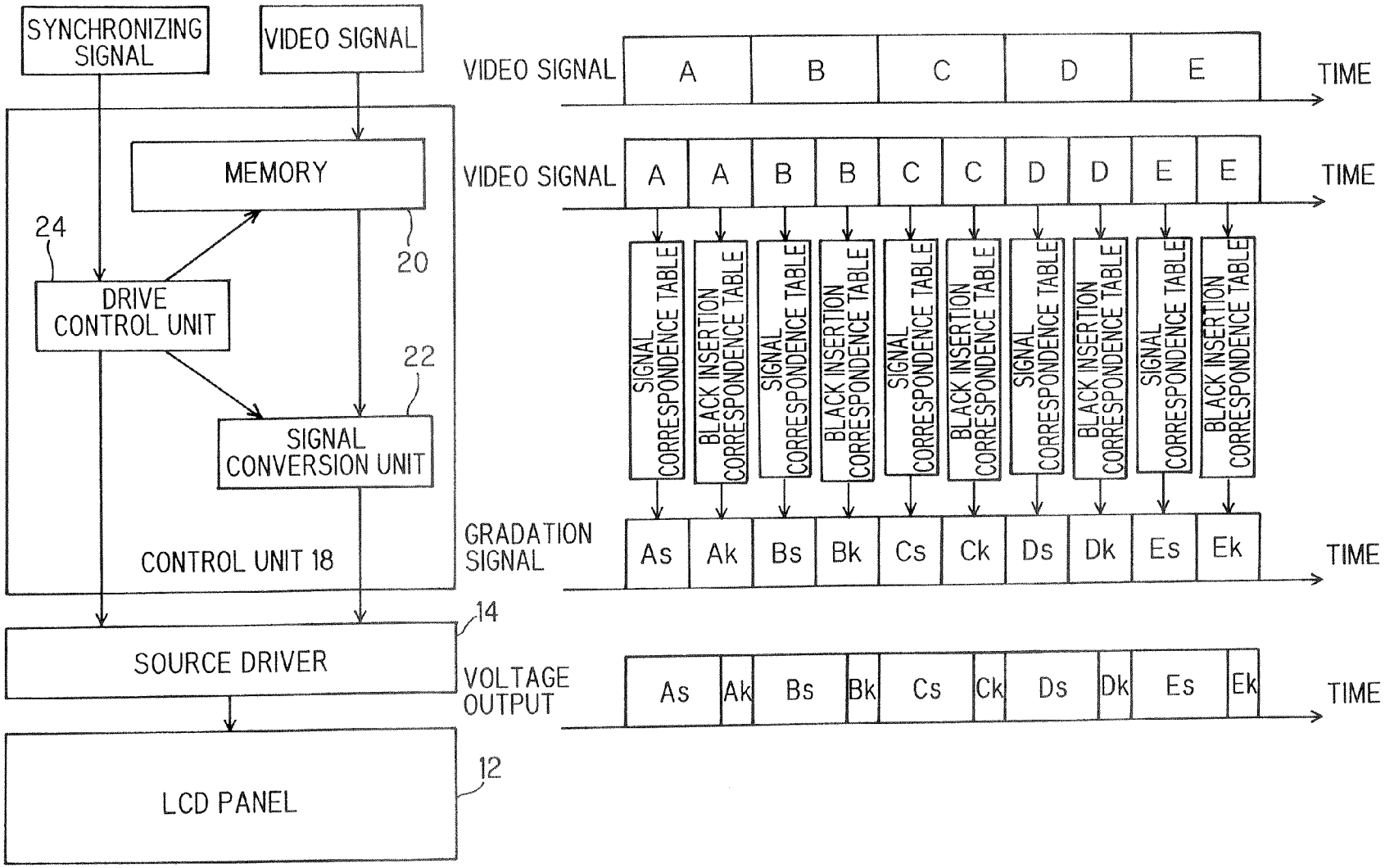
FIG. 5 is a conceptual view of conversion between a video signal and a reverse transition prevention voltage.

The relation between the gradation voltage of the video signal and the value of the reverse transition prevention voltage is stored in the memory 20. The inputted video signal is once stored in the memory 20 in each pixel unit, and in each frame, the reverse transition prevention voltage is calculated from the correspondence table stored in the memory 20 based on the gradation voltage of the video signal. In FIG. 5, for example, in the case where a video signal A is inputted, the video signal A is once stored in the memory 20, and the analog video signal is converted into a digital video signal AS by the signal conversion unit 22 based on the signal correspondence table stored in the memory 20. Besides, a reverse transition prevention voltage AK is obtained in each pixel unit based on the video signal A and based on the black insertion correspondence table stored in the memory 20. Incidentally, this reverse transition prevention voltage is also a gradation voltage, and the gradation varies based on the transmittance shown in FIG. 4. Here, although the reverse transition prevention voltage AK is obtained in each pixel unit, for example, red (R), green (G) and blue (B) are made one set, and the reverse transition prevention voltage AK may be obtained.

FIG. 6 specifically shows the signal correspondence table and the black insertion correspondence table in the memory 20, and in the case where the video signal is inputted in 256 gradations (0 to 255), the digital video signal is expressed by the 128th-255th gradation voltage, and the black insertion, that is, the reverse transition prevention voltage is expressed by the 128th-0th gradation voltage. Where, "*" denotes a pseudo-gradation display. That is, gradation display "*" is displayed by displaying the adjacent gradation displays in series. Incidentally, this signal conversion example is an output example from the source driver 14, the video signal is displayed in pseudo-256 gradations with respect to the display of the source driver in 128 gradations, and the black insertion, that is, the insertion of the reverse transition prevention voltage image is displayed in pseudo-256 gradations with respect to the source driver display in 128 gradations.

(3) Description of Operation State

Next, a specific example in a case where an image display is performed will be described with reference to FIGS. 7A to 7C and FIGS. 8A to 8C.

Figure 7A:
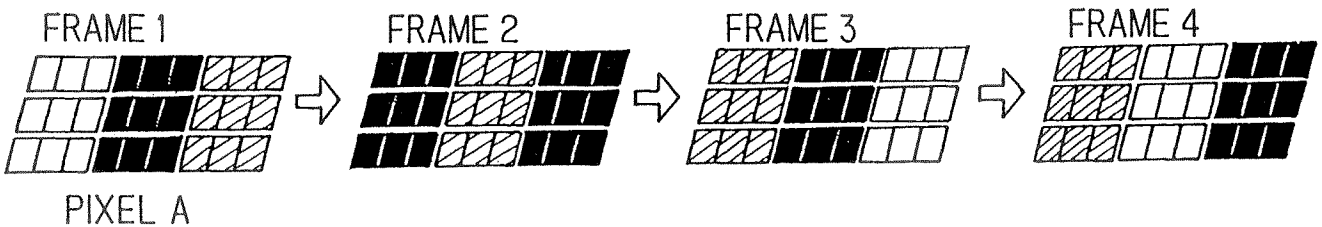
FIGS. 7A to 7C are operation conceptual views showing comparison between the first embodiment and the related art.
Figure 7B:
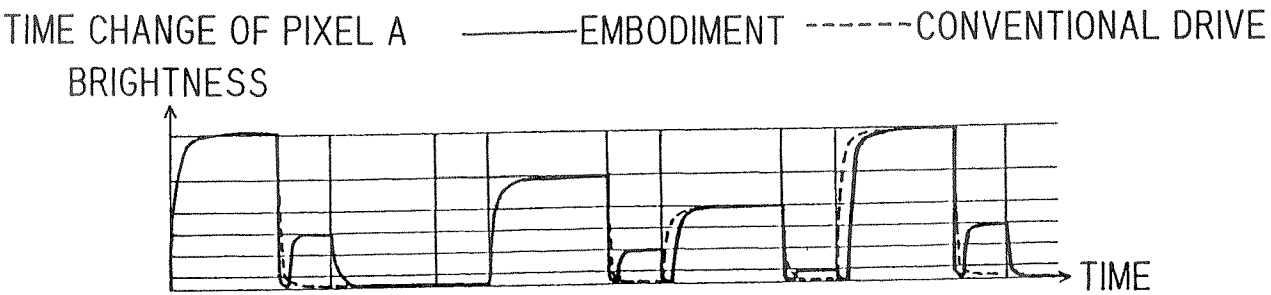
Figure 7C:
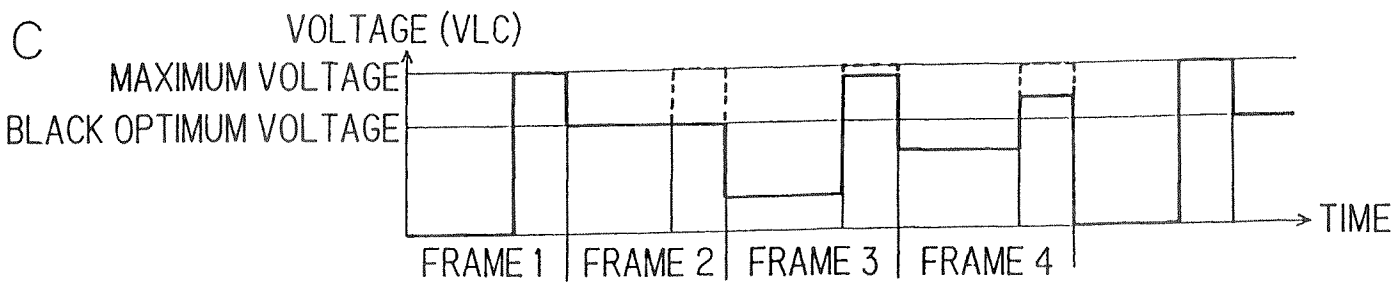

FIG. 7A shows a state of a case where a frame 1 to a frame 4 are displayed in a pixel A, and light and shade represent transmittance. For example, a white is indicated by the 255th gradation, a gray is indicated by the 176th gradation, and a black is indicated by the 0th gradation. FIG. 7B shows a change in brightness for each frame, a solid line indicates this embodiment, and a dotted line indicates a conventional drive state. FIG. 7C shows a change in voltage (VLC) for each frame. For example, in this embodiment, a voltage of from 0 V to 4.5 V is used as an image display voltage.

As shown in FIG. 7B, in this embodiment, for example, in the frame 1, when an applied voltage to the liquid crystal is small (for example, 0 V), and a white display is performed, as a reverse transition prevention voltage image, an image with a high transmittance is inserted based on a voltage higher than the optimum black voltage, for example, a voltage of 6 V. Besides, as shown in the frame 2, in the case where an applied voltage to the liquid crystal is high (for example, 4.5 V), and a black image is displayed, a reverse transition prevention voltage image with a low transmittance is inserted based on a voltage in the vicinity of the optimum black voltage, for example, 4.5 V. Besides, like the frame 3, in the case where a gray picture in which an applied voltage to the liquid crystal is, for example, 2 V is displayed, as a reverse transition prevention voltage image, an image with a transmittance is inserted based on a middle voltage of 5.5 V.

As stated above, in this embodiment, the reverse transition prevention voltage image corresponding to each transmittance in each video display is inserted. That is, in the case where the picture is dark, the black reverse transition prevention voltage image is inserted, and in the case where the picture is bright, the gray or white reverse transition prevention voltage image is inserted, and the reverse transition is effectively prevented without impairing the display quality. Besides, the use efficiency of light can also be improved by the above structure. Further, even in the picture in which black and white are mixed in a selected line, the black display quality is not sacrificed.

Figure 8A:
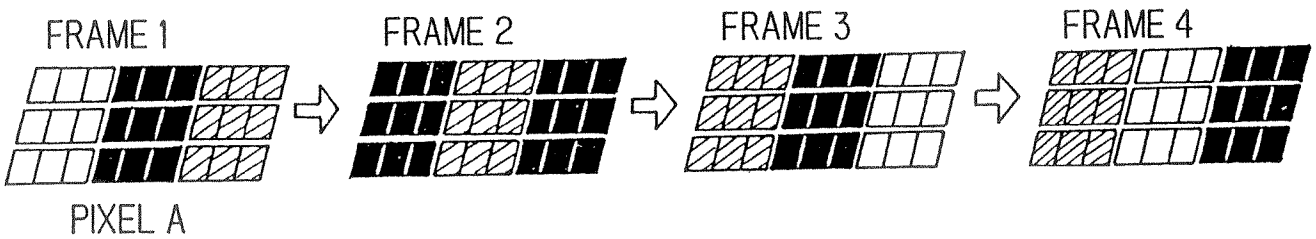
FIGS. 8A to 8C are operation conceptual views in which a comparison is made between pixels in the first embodiment.
Figure 8B:
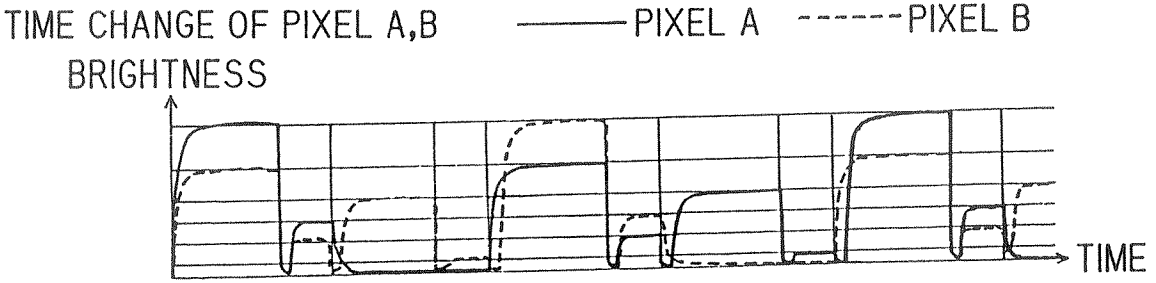
Figure 8C:
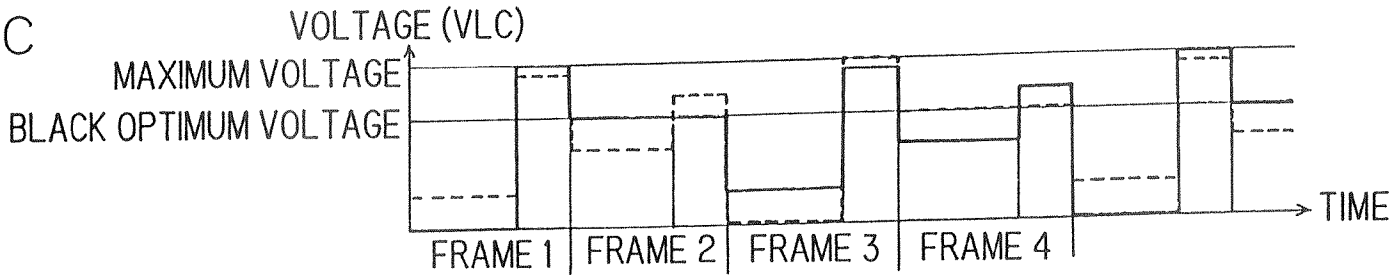

FIGS. 8A to 8C are explanatory views showing an operation state between pixels in a lateral direction.

FIG. 8A shows display states of a frame 1 to a frame 4 of a pixel A and a pixel B, and FIG. 8B shows brightnesses of the pixels A and B and states in the respective frames, in which a solid line indicates the pixel A, and a dotted line indicates the pixel B. FIG. 8C shows changes in voltages of the pixel A and the pixel B for the respective frames.

As shown in FIGS. 8A to 8C, even in the pixel A and the pixel B arranged side by side in the lateral direction in the selected line, the reverse transition prevention voltages are different, and the brightnesses are also different. Accordingly, even in the image in which black and white are mixed in the selected line, the black display quality is not reduced.

Second Embodiment

Figure 9:
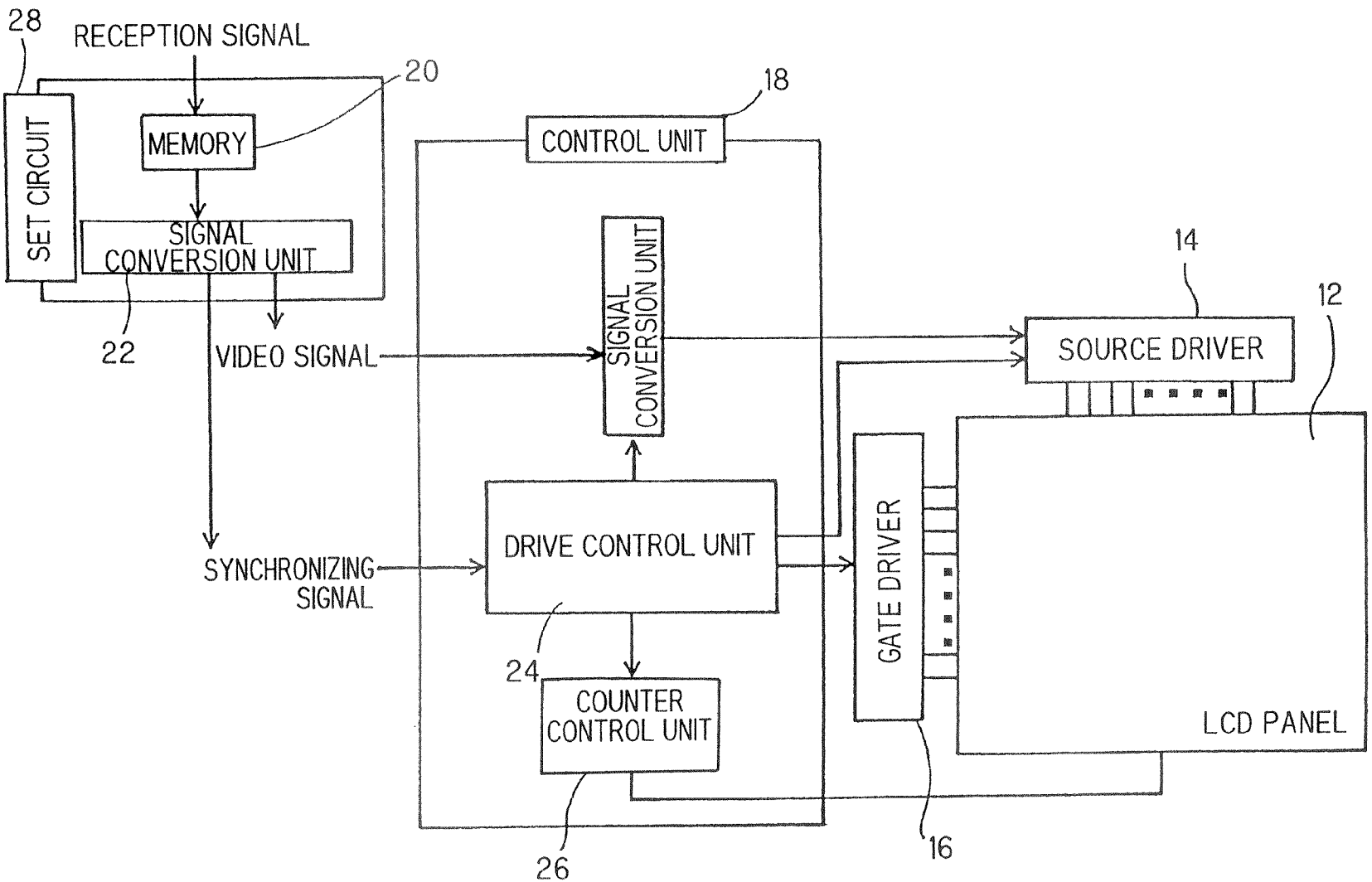
FIG. 9 is a block diagram of a liquid crystal display device of a second embodiment.

An OCB liquid crystal display device 10 of a second embodiment will be described with reference to FIG. 9.

A different point between this embodiment and the first embodiment is that a memory 20 in which the foregoing correspondence table is stored and a signal conversion unit 22 are separate from a control unit 18, and a processing is performed as a set circuit 28 at the stage of a signal processing of an image receiving circuit. That is, in a recent video apparatus, especially in a digital display video apparatus, a frame memory is generally prepared, and display data for a signal and for a reverse transition prevention are created at the stage of a signal processing here. By this, redundancy of memories is avoided, and the signal processing is unified, so that the cost of the liquid crystal display device 10 can be reduced.

Third Embodiment

Next, a third embodiment will be described with reference to FIG. 10. FIG. 10 is a conceptual view of a correspondence table in the third embodiment.

In the first embodiment, the number of gradations of the reverse transition prevention voltage and that of the gradation voltage for the video display are 128 gradations and are equal to each other. However, in order to enrich the expression of the video display, the number of gradations of the video signal is increased, and the number of gradations of the reverse transition prevention voltage is reduced by that. For example, in the case where a 8-bit source driver 14 is used, when 128 gradations are allocated to the reverse transition prevention voltage, only the remaining 128 gradations are used for the video signal. However, a very larger number of gradations are not required for the reverse transition prevention voltage, and a suitable number of gradations (for example, 32 gradations) are sufficient for the reverse transition prevention and for the improvement of light use efficiency.

Then, in the voltage outputs of 0 to 255 gradations of the 8-bit source driver 14, setting is made such that 32 gradations are for the reverse transition prevention voltage, that is, 32 to 255 gradations are for the video signal, and 0 to 32 gradations are for the reverse transition prevention voltage.

By this, an enriched image can be displayed.

In addition to this, for example, with respect to an 8-bit input signal, the source driver is made to deal with 10 bits, 8 bits is made to be used for the video signal, and 2 bits is made to be used for the reverse transition prevention voltage. By this, the representation of the image is not sacrificed.

Besides, a driver for the reverse transition prevention voltage may be provided separately from, for example, the source driver.

What is claimed is:

1. A driving method of a liquid crystal display device having a plurality of display pixel units to perform an image display by combining a video image displayed by a gradation voltage based on a video signal and a reverse transition prevention image displayed by a reverse transition prevention voltage for keeping a bend orientation of liquid crystal molecules, the driving method comprising:

displaying the video image corresponding to the gradation voltage on each of the display pixel units;

determining the reverse transition prevention voltage in each of the display pixel units based on the gradation voltage in said each of the display pixel units independently from other display pixel units so that the determined reverse transition prevention voltages are varied by the display pixel units; and displaying the reverse transition prevention image based on the determined reverse transition prevention voltage on said each of the display pixel units.

2. The driving method of the liquid crystal display device according to claim 1, wherein the reverse transition prevention voltage is selected from voltages not lower than a maximum voltage of the gradation voltage.

3. The driving method of the liquid crystal display device according to claim 2, wherein the liquid crystal display device is normally white, and the maximum value of the gradation voltage is an optimum black display voltage.

4. The driving method of the liquid crystal display device according to claim 1, wherein the reverse transition prevention voltage varies according to a voltage value of the gradation voltage.

5. The driving method of the liquid crystal display device according to claim 4, wherein as the gradation voltage becomes low, the reverse transition prevention voltage is set to be high.

6. The driving method of the liquid crystal display device according to claim 1, further comprising:

storing, in a storage unit, a correspondence relation between the reverse transition prevention voltage and the gradation voltage, and selecting the reverse transition prevention voltage corresponding to the gradation voltage from the storage unit.

7. The driving method of the liquid crystal display device according to claim 1, wherein the video image and the reverse transition prevention image are alternately displayed.

8. The driving method of the liquid crystal display device according to claim 1, wherein a number of gradations of the gradation voltage is larger than a number of gradations of the reverse transition prevention voltage.

9. The driving method of the liquid crystal display device according to claim 1, wherein a liquid crystal of the liquid crystal display device is of an OCB type.

10. The driving method of the liquid crystal display device according to claim 1, wherein the pixel unit includes different color pixels as one set.

11. A liquid crystal display device having a plurality of display pixel units to perform an image display by combining a video image displayed by a gradation voltage based on a video signal and a reverse transition prevention image displayed by a reverse transition prevention voltage for keeping a bend orientation of liquid crystal molecules, the liquid crystal display device comprising:

a first controller configured to vary the reverse transition prevention voltages by the display pixel units so that, based on the gradation voltage in each of the display pixel units, a reverse transition preventing voltage is determined independently from other display pixel units; and a second controller configured to display the reverse transition prevention image based on the determined reverse transition prevention voltage on said each of the display pixel units.

12. The liquid crystal display device according to claim 11, wherein the reverse transition prevention voltage is selected from voltages not lower than a maximum voltage of the gradation voltage.

13. The liquid crystal display device according to claim 12, wherein the liquid crystal display device is normally white, and the maximum value of the gradation voltage is an optimum black display voltage.

14. The liquid crystal display device according to claim 11, wherein the reverse transition prevention voltage varies according to a voltage value of the gradation voltage.

15. The liquid crystal display device according to claim 14, wherein as the gradation voltage becomes low, the reverse transition prevention voltage is set to be high.

16. The liquid crystal display device according to claim 11, further comprising:

a storage unit that stores a correspondence relation between the reverse transition prevention voltage and the gradation voltage, and the reverse transition prevention voltage corresponding to the gradation voltage is selected from the storage unit.

17. The liquid crystal display device according to claim 11, wherein the video image and the reverse transition prevention image are alternately displayed.

18. The liquid crystal display device according to claim 11, wherein a number of gradations of the gradation voltage is larger than a number of gradations of the reverse transition prevention voltage.

19. The liquid crystal display device according to claim 11, wherein a liquid crystal of the liquid crystal display device is of an OCB type.

20. The liquid crystal display device according to claim 11, wherein the pixel unit includes different color pixels as one set.

21. A liquid crystal display device to perform an image display by combining a video image displayed by a gradation voltage corresponding to a video signal and a non-video image displayed by a non-video voltage in each frame period, the liquid crystal display device comprising:

a liquid crystal display panel having a plurality of display pixel units each of which includes an array electrode, a counter electrode and a liquid crystal sandwiched therebetween;

a first controller configured to determine the voltage value of the non-video voltage in each of the display pixel units based on a gradation voltage in said each of the display pixel units independently from other display pixel units; and a second controller configured to apply the gradation voltage in said each of the display pixel units to a corresponding pixel electrode and to apply the determined non-video voltage to the corresponding pixel electrode sequentially, wherein the voltage value of the non-video voltage corresponds to a dark image display when the gradation voltage corresponds to the dark image display, and the voltage value of the non-video voltage does not correspond to the dark image display when the gradation voltage corresponds to a bright image display.

22. The liquid crystal display device according to claim 21, wherein the non-video voltage is selected from voltages not lower than a maximum voltage of the gradation voltage.

23. The liquid crystal display device according to claim 22, wherein the liquid crystal display device is normally white, and the maximum value of the gradation voltage is an optimum black display voltage.

24. The liquid crystal display device according to claim 21, wherein the non-video voltage varies according to a voltage value of the gradation voltage.

25. The liquid crystal display device according to claim 24, wherein as the gradation voltage becomes low, the non-video voltage is set to be high.

26. The liquid crystal display device according to claim 21, further comprising:

a storage unit that stores a correspondence relation between the non-video voltage and the gradation voltage, and the non-video voltage corresponding to the gradation voltage is selected from the unit.

27. The liquid crystal display device according to claim 21, wherein the video image and the non-video image are alternately displayed.

28. The liquid crystal display device according to claim 21, wherein the liquid crystal display panel includes a liquid crystal of an OCB type.

29. A liquid crystal display device to perform an image display by combining a video image displayed by a gradation voltage corresponding to a video signal and an non-video image displayed by an non-video voltage in each frame period, the liquid crystal display device comprising:

a liquid crystal display panel having a plurality of display pixel units, each of which includes an array electrode, a counter electrode and a liquid crystal sandwiched therebetween;

a first controller configured to determine the voltage value of the non-video voltage in each of the display pixel units based on a gradation voltage in said each of the display pixel units independently from other display pixel units; and a second controller configured to apply the gradation voltage in said each of the display pixel units to a corresponding pixel electrode and to apply the determined non-video voltage to the corresponding pixel electrode sequentially, wherein the voltage value of the non-video voltage corresponds to a dark image display when the gradation voltage corresponds to the dark image display, and the voltage value of the non-video voltage corresponds to a gray or white image display when the gradation voltage corresponds to a bright image display.

* * * * *